US005475461A

United States Patent [19]

Fyson et al.

[11] Patent Number: 5,475,461

[45] Date of Patent: Dec. 12, 1995

[54] PHOTOGRAPHIC PROCESSING APPARATUS

[75] Inventors: John R. Fyson; Edward C. T. S. Glover, both of London, United Kingdom

[73] Assignee: Eastman Kodak Company, Rochester, N.Y.

[21] Appl. No.: 244,351

[22] PCT Filed: Nov. 25, 1992

[86] PCT No.: PCT/EP92/02710

§ 371 Date: May 26, 1994

§ 102(e) Date: May 26, 1994

[87] PCT Pub. No.: WO93/11464

PCT Pub. Date: Jun. 10, 1993

[30] Foreign Application Priority Data

Nov. 28, 1991 [GB] United Kingdom ..... 9125297

[51] Int. Cl.[6] ..... G03D 3/08

[52] U.S. Cl. ..... 354/319; 354/330

[58] Field of Search ..... 354/313, 319–324, 354/329–331; 134/64 P, 64 R, 122 P, 122 R; 430/398–400

[56] References Cited

U.S. PATENT DOCUMENTS 3,368,526 2/1968 Matsumoto et al. ..... 118/662
3,690,758 9/1972 Knechtel et al. ..... 354/331 X
4,003,070 1/1977 Merz et al. ..... 354/322
4,613,223 9/1986 Cherry et al. ..... 354/322

FOREIGN PATENT DOCUMENTS 2010736 11/1970 Germany .

OTHER PUBLICATIONS

Patent Abstracts of Japan, vol. 13, No. 73, Feb. 20, 1989

Patent Abstracts of Japan, vol. 6, No. 41, Mar. 13, 1982.

*Primary Examiner*—D. Rutledge
*Attorney, Agent, or Firm*—Nixon, Hargrave, Devans & Doyle

[57] ABSTRACT

A photographic processing apparatus which incorporates a drum arrangement to form a low volume processing tank. The arrangement comprises a processing tank in which a central rotatable drum is mounted and a pair of rollers at the inlet and outlet of the processing tank convey the photographic material through the tank. A clearance, of less than 5 mm, is provided between the tank and the drum, which defines a low volume for the processing solution. The drum is rotated at a speed independent of the speed of the rollers. The processing apparatus may be used with unstable or single use chemistry.

11 Claims, 1 Drawing Sheet

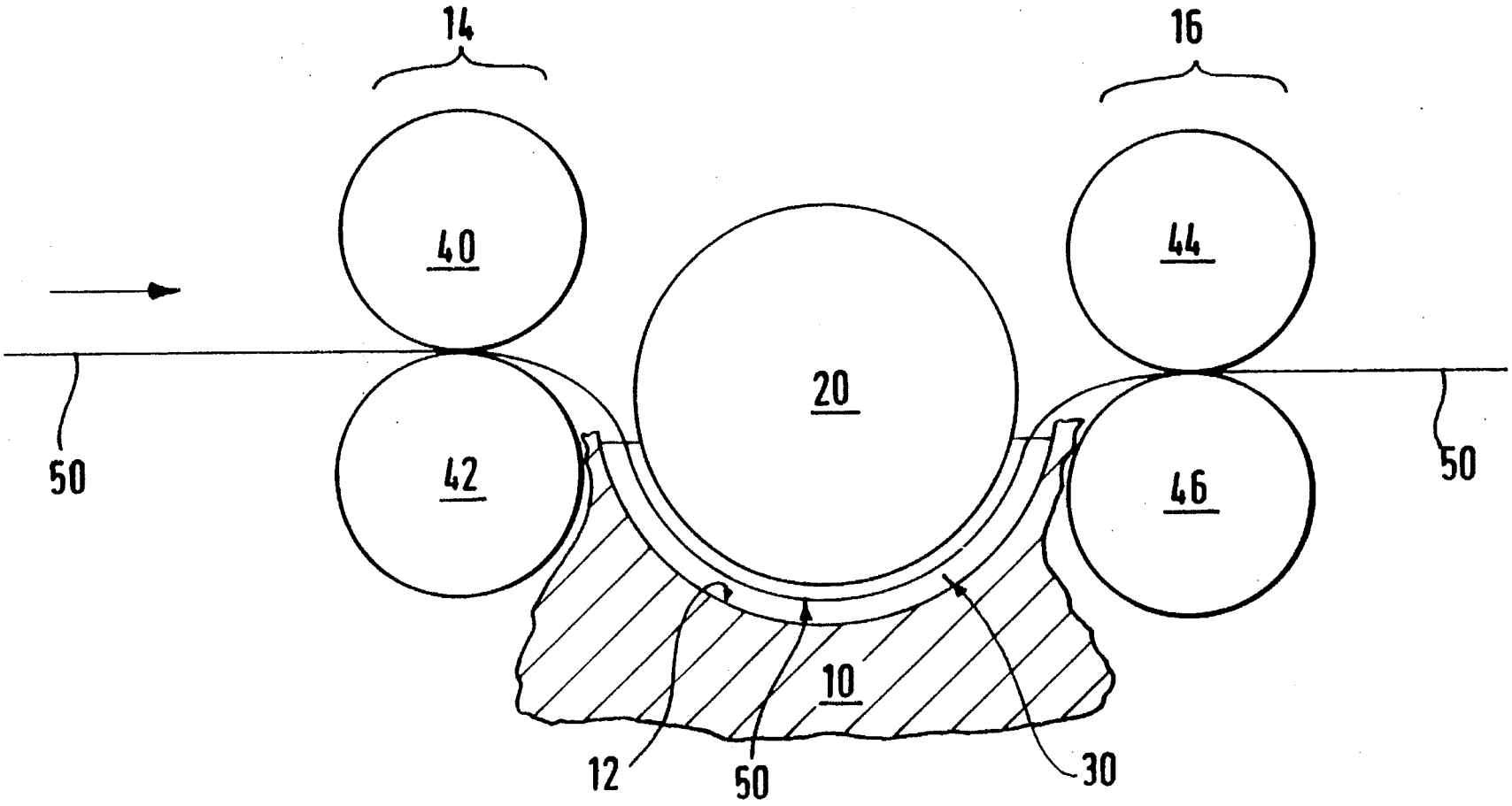
16
14
44
46
40
42
20
10
30
50
12
50
50

PHOTOGRAPHIC PROCESSING APPARATUS

BACKGROUND OF THE INVENTION

This invention relates to photographic processing apparatus and is more particularly concerned with the processing of small areas of photographic material, for example, prints on photographic paper.

It is well-known to use rotating drums in photographic processing apparatus. U.S. Pat. No. 4,613,223 discloses an arrangement in which a flexible sheet of photographic material is driven along an endless curved path within a processing tank by passing the sheet through nips formed between at least one pair of driven rollers. At least one of the driven rollers is the drum itself. During processing, the emulsion (sensitive) surface of the sheet is arranged not to come into contact with any stationary part of the processing vessel as it is being processed. This prevents damage to the surface during processing. After driving the sheet around the endless path for a predetermined number of cycles, which defines the processing time, the sheet is then directed out of the processing tank.

The arrangement described above, has the disadvantage that little or no agitation is applied to the emulsion surface of the photographic material being processed. This may result in uneven processing of the material and variable sensitometry.

Furthermore, relatively large volumes of processing solution are required which makes the arrangement disclosed unsuitable for unstable processing chemistry and single use chemistry as large volumes of processing solutions need to be discarded on a regular basis.

SUMMARY OF THE INVENTION

It is therefore an object of the present invention to provide photographic processing apparatus which overcomes the problems mentioned above.

According to one aspect of the present invention, there is provided photographic processing apparatus including at least ode processing stage, each processing stage comprising:

a generally U-shaped vessel;

a central rotating drum arranged within the vessel to define a processing tank, the clearance between the vessel and the drum being substantially constant; and at least one pair of drive rollers associated with the processing stage which is arranged to direct photographic material into and through the tank during processing, the rollers being driven at a rate to ensure that processing is achieved as the material passes through the processing tank;

characterized in that the speed of rotation of the drum is controlled independently of the speed of the drive rollers.

By this arrangement, only low volumes of processing solution are required allowing unstable and single use processing chemistry to be used.

Preferably, the clearance between the drum and the interior surface of the processing tank is less than 5 mm, and most preferably, less than 2 mm.

BRIEF DESCRIPTION OF THE DRAWING

For a better understanding of the present invention, reference will now be made, by way of example only, to the accompanying drawing, the single FIGURE of which is a Schematic illustration of processing apparatus constructed in accordance with the present invention.

DETAILED DESCRIPTION OF THE INVENTION

The arrangement to be described may be the only processing stage of a photographic processor, or it may form one of several similar stages.

In the Figure, a generally U-shaped processing tank 10 is shown. A central rotatable drum 20 is mounted in the tank 10 with a clearance between interior surface 12 of the tank 10 and the drum 20 of approximately 1 mm. Processing solution 30 is held in the tank 10 at the level shown. Two pairs of rollers 40, 42 and 44, 46 are respectively positioned at the inlet 14 and the outlet 16 of the tank 10. Photographic material is fed into the tank 10 by one pair of rollers 40, 42, at the inlet, passes around half of the drum 20 and then out of the tank 10 and through the other pair of rollers 44, 46. Rollers 44, 46 may be squeegee rollers to remove excess processing solution from the material before it passes to the next stage of the apparatus.

Rollers 40, 42, drive the material 50, for example, photographic paper, through the processing tank 10 at a rate to ensure that processing is completed in the time that the material 50 passes through inlet rollers 40, 42, through the tank 10 and out through outlet rollers 44, 46. The time during which the material is processed is determined by the speed of roller pair 40, 42.

The tank 10 and drum 20 may be made from any suitable material, for example, stainless steel or a plastics material. The tank 10 is made water-tight by fitting end plates (not shown) close to the end of the drum 20 allowing sufficient clearance so that the drum 20 can rotate freely. The drum 20 is driven by a suitable motor (not shown).

Rollers 40, 42 are driven by a suitable motor (not shown) which operates independently of the motor driving the drum 20. This allows the drum speed to be independently controlled from the motion of the paper 50 being processed.

Additionally, roller pair 44, 46 may also be driven by the same motor as roller pair 40, 42.

The drum 20 may be hollow (not shown) to allow warm water, or any other suitable liquid, to be passed through it to maintain the processing solution in the tank 10 at the correct processing temperature. The temperature may also be maintained by incorporating a heater inside the drum 20. If such a heater is used, this may be surrounded by a liquid to enhance the distribution of heat to the processing solution 30 in the tank 10.

The photographic paper 50 may be processed either with its emulsion surface against or away from the surface of the drum. In the former case, agitation during processing can be controlled. In the latter case, the drum may be stationary relative to the paper, or rotating at a speed to prevent the photographic paper adhering to the surface of the drum. In another embodiment, the drum may be stationary with respect to the vessel in which it is mounted, relative movement being obtained by driving the paper through the tank 10.

The motors used to drive the drum 20 and the pairs of rollers 40, 42; 44, 46 may be electric, pneumatic or hydraulic motors. Alternatively, the drum can be driven manually, for example using a handcrank.

In a particular example of the present invention, a drum 20 was made from smooth stainless steel tube of diameter 10 cm and of length 30 cm. This size of drum allowed A4 size paper to be processed. The tank 10 was moulded from PVC to fit around the drum 20 with a gap of 1±0.5 mm.

The tank 10 was filled with 52 ml of RA4 developer, and a tank of RA4 bleach-fix was positioned at the outlet 16 so that the paper 50 fell into this bath after passing through rollers 44, 46. Water at 35° C. was passed through the drum 20 during processing of the paper 50. The speed of the inlet rollers 40, 42 was set so that the processing time was 45 s.

Prints were exposed and processed with the emulsion surface away from the surface of the drum 20, the drum being driven at a different speed to the rollers 40, 42 so that a surface speed of between 0 and 60 m/min was obtained.

Even strips were produced with good sensitometry. It was found that the drum speed had little effect on the sensitometry but faster drum speeds prevented the paper from sticking to its surface.

In another example, the process was repeated with the emulsion surface of the paper 50 facing the drum 20. Again even prints were produced providing that the speed at the surface of the drum exceeded 20 m/min. It was found that the emulsion surface adhered to the surface of the drum at lower drum speeds. This arrangement provided very good agitation and it was found that good sensitometry could be produced with a 30 s process. This provides a reduction of 33% in the process time. Alternatively, a lower water temperature of 32° C. could be used for a process time of 45 s.

It is the case therefore, that if the volume of the tank is small, increased drum agitation provides shorter or cooler processes with good sensitometry.

The arrangement according to the present invention allows for varied agitation. This is achieved by having a difference in speed between the drive rollers 40, 42 and the drum 20. As the agitation is variable, adjustment can be made to obtain the desired sensitometry.

As the tank can be constructed to hold only a small volume of liquid, unstable chemistry, such as redox amplification, otherwise known as RX, development can be used with low wastage. Furthermore, single use chemistry could also be used.

Naturally, the outside diameter of the drum 20 is chosen to accommodate the size of material to be processed.

The surface of the drum 20 may be patterned to prevent the paper adhering to the drum during processing and also to provide better uptake of the processing solution. If the agitation is sufficient, a liquid bearing is formed and the material rides on this.

We claim:

1. Photographic processing apparatus including at least one processing stage, each processing stage comprising:

a generally U-shaped vessel;

a central rotating drum arranged within the vessel to define a processing tank, the clearance between the vessel and the drum being substantially constant; and at least one pair of drive rollers associated with the processing stage which is arranged to direct photographic material into and through the tank during processing, the rollers being driven at a rate to ensure that processing is achieved as the material passes through the processing tank;

characterized in that the speed of rotation of the drum is controlled independently of the speed of the drive rollers.

2. Apparatus according to claim 1, wherein the clearance is less than 5 mm.

3. Apparatus according to claim 2, wherein the clearance is less than 2 mm.

4. Apparatus according to claim 1, wherein the drum is hollow.

5. Apparatus according to claim 1, wherein at least one pair of rollers is positioned at the inlet to the processing stage with which it is associated.

6. Apparatus according to claim 5, wherein a second pair of rollers is provided at the outlet from the processing stage for directing the processed material out of that stage.

7. Apparatus according to claim 6, wherein the second pair of rollers form squeegee rollers for removing excess processing solution as the material leaves the processing stage.

8. Apparatus according to claim 1, wherein the photographic material to be processed is fed into the processing stage with its emulsion surface against the surface of the drum.

9. Apparatus according to claim 1, wherein the surface of the drum is textured to assist in the uptake of processing solution from the processing tank.

10. Apparatus according to claim 1, wherein the drum, has a diameter of 10 cm and is of length 30 cm.

11. Apparatus according to claim 1, wherein the drum is heated.

* * * * *